United States Patent [19]

Neal

[11] Patent Number: 4,796,361

[45] Date of Patent: Jan. 10, 1989

[54] WELDING ELECTRODE CAN OPENER

[76] Inventor: Kyle R. Neal, Rte. 1, Box 63, Gibson, Ga. 30810

[21] Appl. No.: 155,583

[22] Filed: Feb. 12, 1988

[51] Int. Cl.[4] ..... B26F 1/02

[52] U.S. Cl. ..... 30/447; 30/305; 30/367; 30/445

[58] Field of Search ..... 30/305, 315, 367, 400, 30/410, 443–448; 83/586

[56] References Cited

U.S. PATENT DOCUMENTS

| | | | |
|---|---|---|---|
| 1,321,578 | 11/1919 | Ward | 30/445 |
| 1,855,978 | 4/1932 | Malone | 30/445 X |
| 1,992,498 | 2/1935 | McKune . | |
| 2,162,095 | 6/1939 | Maples . | |
| 2,272,204 | 2/1942 | Hothersall . | |
| 2,576,926 | 12/1951 | Donnelly . | |
| 2,656,598 | 10/1953 | Birdsall . | |
| 2,832,410 | 4/1958 | Soss | 83/586 X |
| 3,054,178 | 9/1962 | Heiser et al. . | |

FOREIGN PATENT DOCUMENTS

| | | | |
|---|---|---|---|
| 2038163 | 7/1980 | United Kingdom | 83/586 |

*Primary Examiner*—Donald R. Schran
*Assistant Examiner*—Michael D. Folkerts
*Attorney, Agent, or Firm*—Jerry T. Kearns

[57] ABSTRACT

A can opener has an elongated rectangular base plate on which a can support box is centrally mounted. Four right angle corner rails extend upwardly from corners of the support box. The rails are connected by side support braces which form a square around midpoints of the corner rails. A top guide plate is secured to upper ends of the corner rails. A pair of slide bearings in the top guide mount a pair of slide rods. A transversely extending cross bar is secured to upper ends of the slide rods. The cross bar has a handle grip at each end. A blade mounting plate is secured to the lower ends of the slide rods. Four triangular tempered steel blades are secured to the side edges of the blade mounting plate. The blades extend perpendicularly downwardly from the blade mounting plate. L-shaped side support rods extend from opposite sides of the base plate to the side support braces. A pair of coiled springs extend between the transverse cross bar and the side support rods. In use, a user stands on the base plate and raises the transverse cross bar and attached blade assembly. By placing a welding electrode can in the can support box and releasing the cross bar handles, the blades will be snapped downwardly by the springs to sever the top from the welding rod can. A rubber block on the top guide plate cushions the cross bar.

1 Claim, 3 Drawing Sheets

WELDING ELECTRODE CAN OPENER

BACKGROUND OF THE INVENTION

1. Field of the Invention

The present invention relates to can openers, and more particularly pertains to a new and improved can opener specifically designed for opening welding electrode cans. Welding electrodes are packaged in square or rectangular metal cans. The top of the can is slightly recessed below the side walls of the can. The corners of the electrode can are slightly radiused. These features prevent the use of conventional forms of can openers for opening these electrode cans. Currently, various methods are utilized for opening these electrode cans on a construction sight. For example, hack saws, hammer driven knives and cutting torches are utilized. These conventional methods are inefficient, time consuming and unsafe. Additionally, these methods leave a jagged edge on the electrode can which is dangerous for workers. In order to overcome these disadvantages, the present invention provides a welding electrode can opener which is inexpensive, quick, efficient and safe.

2. Description of the Prior Art

Various types of can openers are known in the prior art. A typical example of such a welding electrode can opener is to be found in U.S. Pat. No. 1,992,498, which issued to C. McKune on Feb. 26, 1935. This patent discloses a can opener which utilizes a sharpened punch actuated by a rack and pinion mechanism to punch air vent openings in the top surface of cans. U.S. Pat. No. 2,162,095, which issued to A. Maples on June 13, 1939, discloses a can opener which utilizes a triangular shaped punch blade to provide an aperture in a top surface of a can. The blade is pivoted into active position by a cam mechanism. U.S. Pat. No. 2,272,204, which issued to J. Hothersall on Feb. 10, 1942, discloses a can opener with a pivotal can support and a sharpened punch type blade for engagement with the top surface of a can. U.S. Pat. No. 2,576,926, which issued to J. Donnelly on Dec. 4, 1951, discloses a can opener having a sharpened punch type blade which is mounted for reciprocating movement by a rack and pinion mechanism. U.S. Pat. No. 2,656,598, which issued to B. Birdsall on Oct. 27, 1953, discloses a can opener having a circular saw tooth blade mounted for vertical reciprocating movement by a rachet mechanism. U.S. Pat. No. 3,054,178, which issued to W. Heiser et al on Sept. 18, 1962, discloses a can opener which utilizes a vertically reciprocating heated piercing tool for providing an aperture in a top surface of a can.

While the above mentioned devices are suited for their intended usage, none of these devices provides a can opener suitable for use with welding electrode cans. Additionally, none of the aforesaid prior art can opening devices utilize four triangular tempered steel blades which are perpendicularly secured to a vertically reciprocating blade support plate. An additional feature of the present invention, not contemplated by the aforementioned prior art devices, is the use of triangular shaped tempered steel blades which are downwardly driven by a spring mechanism. Inasmuch as the art is relatively crowded with respect to these various types of can openers, it can be appreciated that there is a continuing need for and interest in improvements to such can openers, and in this respect, the present invention addresses this need and interest.

SUMMARY OF THE INVENTION

In view of the foregoing disadvantages inherent in the known types of can openers now present in the prior art, the present invention provides an improved welding electrode can opener. As such, the general purpose of the present invention, which will be described subsequently in greater detail, is to provide a new and improved welding electrode can opener which has all the advantages of the prior art can openers and none of the disadvantages.

To attain this, a representative embodiment of the concepts of the present invention is illustrated in the drawings and makes use of an elongated rectangular base plate on which a can receiving and support box is centrally mounted. Four elongated right angle corner rails extend upwardly from corners of the can support box. The upstanding corner rails are connected by side support braces which form a square around mid points of the corner rails. A square top guide plate is secured to upper ends of the corner rails. A pair of slide bearings in the top guide plate slidably mount a pair of slide rods. A transversely extending cross bar is secured to upper ends of the slide rods. The cross bar has handle grips at each end. A square blade mounting plate is secured to the lower ends of the slide rods. Four triangular tempered steel blades are secured to the side edges of the blade mounting plate. The blades extend perpendicularly downwardly from the blade mounting plate. L-shaped side support rods extend from opposite sides of the base plate to the side support braces. A pair of coiled spring extend between the transverse cross bar and the side support rods. In use, a user stands on the base plate and raises the transverse cross bar and attached blade assembly. By placing a welding rod can in the can support box and releasing the cross bar handles, the blades will be snapped downwardly by the springs to sever the top from the welding rod can. A rubber shock absorbing block on the top guide plate cushions the cross bar.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Dffice and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved welding electrode can opener which has all the advantages of the prior art can openers and none of the disadvantages.

It is another object of the present invention to provide a new and improved welding electrode can opener which may be easily and efficiently manufactured and marketed.

It is a further object of the present invention to provide a new and improved welding electrode can opener which is of a durable and reliable construction.

An even further object of the present invention is to provide a new and improved welding electrode can opener which is susceptible of a low cost of manufacture with regard to both materials and labor, and which accordingly is then susceptible of low prices of sale to the consuming public, thereby making such can openers economically available to the buying public.

Still yet another object of the present invention is to provide a new and improved welding electrode can opener which provides in the apparatuses and methods of the prior art some of the advantages thereof, while simultaneously overcoming some of the disadvantages normally associated therewith.

Still another object of the present invention is to provide a new and improved welding electrode can opener which provides a quick, efficient and safe means for opening electrode cans.

Yet another object of the present invention is to provide a new and improved welding electrode can opener which utilizes four downwardly extending tempered steel triangular blades to remove an end wall of an electrode can.

Even still another object of the present invention is to provide a new and improved welding electrode can opener which utilizes transversely extending triangular tempered steel blades which are provided with a spring actuation method.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
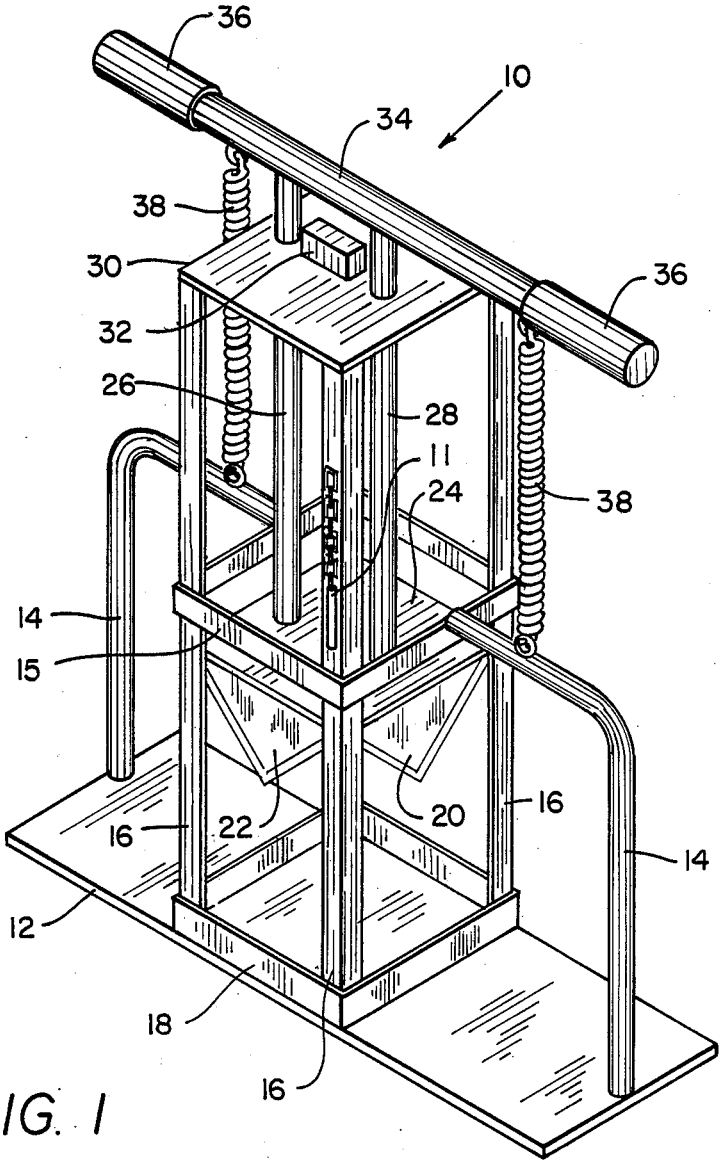
FIG. 1 is a perspective view of the welding electrode can opener of the present invention.

With reference now to the drawings, and in particular to FIG. 1 thereof, a new and improved welding electrode can opener embodying the principles and concepts of the present invention and generally designated by the reference numeral 10 will be described.

More specifically, it will be noted that the first embodiment 10 of the invention includes an elongated rectangular base plate 12. A can receiving and support box 18 is formed by upstanding walls on a central top portion of the base plate 12. Four right angle corner rails 16 extend upwardly from the base plate 12 and are disposed at the corners of the can support box 18. Four side support braces 15 connect the corner rails 16 at midpoints thereof. The side support braces 15 form a square around the rails 16. Two L-shaped side support rods 14 are secured on opposite ends of the base plate 12. A first end of each of the side support rods 14 is secured to one of the side support braces 15 and an opposite end of each of the side support rods 14 is secured to the base plate 12, as illustrated. A square top guide plate 30 is connected to the upper ends of the corner rails 16. The top guide plate 30 has a pair of circular guide apertures which slidably receive a pair of elongated circular slide rods 26 and 28. A square blade mounting plate 24 is transversely connected to bottom ends of the slide rods 26 and 28. Four tempered steel triangular blades 20 and 22 extend perpendicularly downward from side edges of the blade mounting plate 24. The blades are preferably formed from a high carbon steel having a thickness of about one sixteenths on an inch. A transversely extending cross bar 34 is connected to upper ends of the slide rods 26 and 28. A pair of handle grips 36 are received on opposite ends of the cross bar 34. A pair of coil springs 38 extend between the cross bar 34 and the L-shaped side support rods 14, as shown. A rubber shock absorbing block 32 is secured to the top surface of the guide plate 30, between the slide rods 26 and 28. The shock absorbing block 32 serves to cushion the impact of the cross bar 34. In use, a welding electrode can is placed on end, within the can support box 18. The blade mounting plate 24 is then raised by an individual standing on the base plate 12 and lifting the handle grips 36 against the bias of the springs 38. The handle grips 36 are then released and the blade mounting plate 24 is then driven downwardly, causing the blades 20, 22 to sever the top end from the electrode can. It should be understood that the configuration of the can support box 18, blade mounting plate 24 and top guide plate 30 may be adapted in configuration for use with electrode cans having rectangular, rather than square top ends. A pin 11 is secured by a chain to one of the corner rails 16, and is utilized to dislodge the severed can top from between the blades 20,22.

Figure 2:
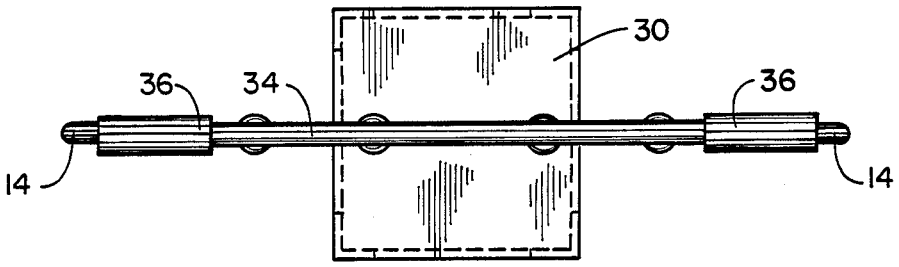
FIG. 2 is a top view of the welding electrode can opener of the present invention.

In FIG. 2, a top view of the electrode can opener of the present invention is depicted. The view looks downwardly upon the transverse cross bar 34, handle grips 36 and top guide plate 30. The shock absorbing block 32 is obscured by the cross bar 34.

Figure 3:
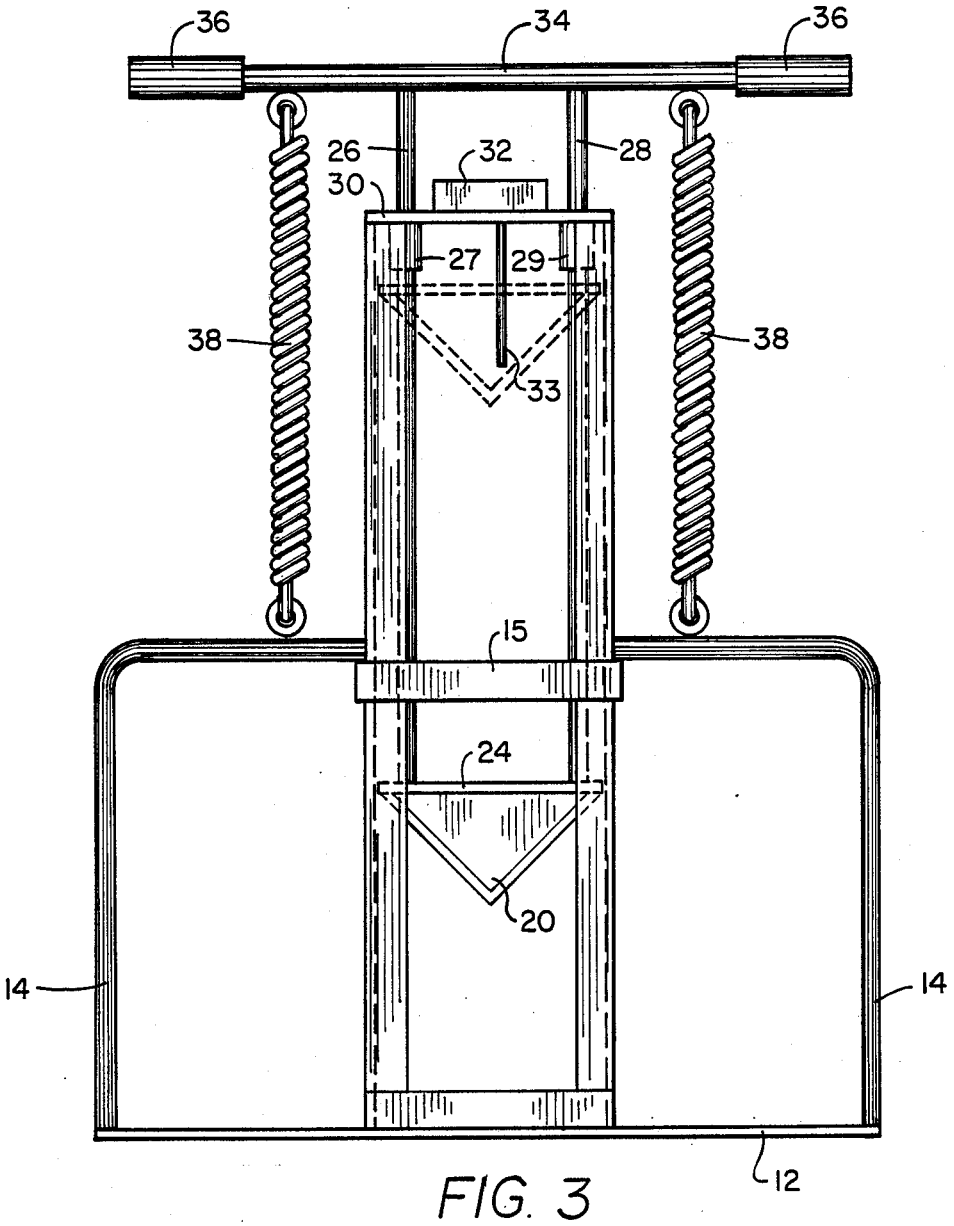
FIG. 3 is a front view of the welding electrode can opener of the present invention.

In FIG. 3, a front view of the can opener 10 of the present invention is provided. An elongated ejector pin 33 is perpendicularly connected at a central point on the bottom surface of the top guide plate 30. The ejector pin 33 serves to remove the welding rod can top from engagement between the blades 20 and 22 on the blade mounting plate 24. Slide bearings 27 and 29 are mounted on the underside of the top guide plate 30 and slidably receive the rods 26 and 28 for vertical sliding movement.

Figure 4:
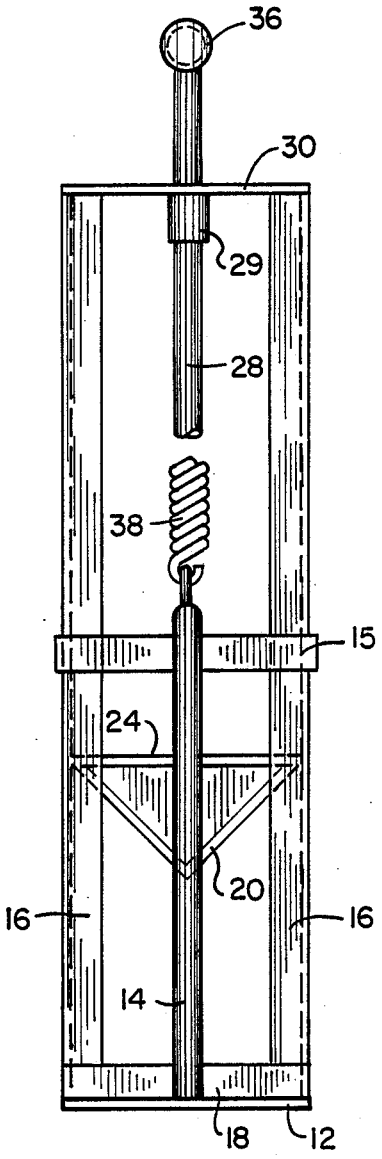
FIG. 4 is a side view of the welding electrode can opener of the present invention.

In FIG. 4, a side view of the welding electrode can opener 10 of the present invention is provided. The spring 38 is partially cut away to illustrate the rod 28. As may now be clearly understood, the rails 16 form a rectangular enclosure in which the blade mounting plate 24 is slidably received. This construction safely encloses the cutting blades 20 and 22, preventing possible injury to a user.

Figure 5:
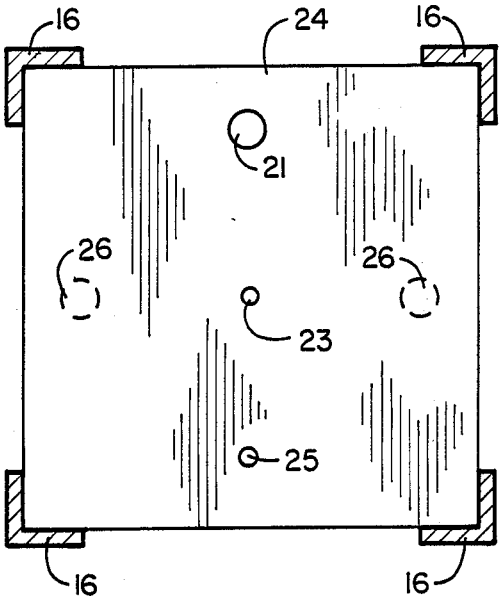
FIG. 5 is a transverse cross sectional view of the welding electrode can opener of the present invention, illustrating the top surface of the blade mounting plate.

In FIG. 5, a transverse cross sectional view is provided, which illustrates the upper surface of the blade mounting plate 24. A central circular aperture 23 in the blade mounting plate 24 allows the ejector pin 33 (FIG. 3) to dislodge a welding electrode can top from between the four downwardly extending triangular blades. Additional apertures 21 and 25 are provided for receipt of the manually manipulated pin 11 (FIG. 1), to further facilitate the removal of the severed can top.

Figure 6:
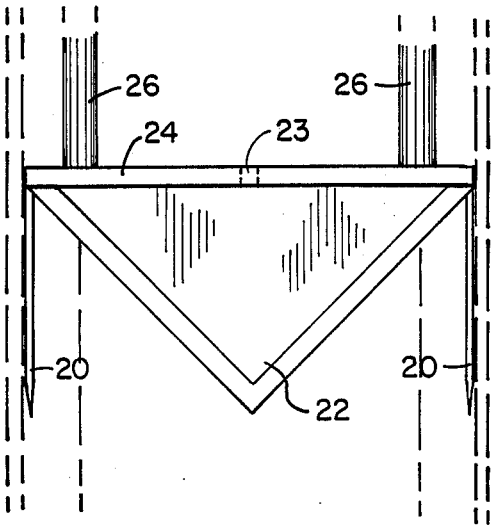
FIG. 6 is a partial front view of the welding electrode can opener of the present invention, illustrating the blade assembly.

In FIG. 6, a partial front detail view is provided, illustrating the blade mounting plate 24. A first triangular shaped tempered steel blade 22 extends downwardly from a front side edge of the mounting plate 24. An additional triangular blade 22 is hidden from view behind the illustrated blade 22 and extends parallel therewith from the back side edge of the mounting plate 24. The two triangular cutting blades 20 extend in parallel relation from opposite side edges of the mounting plate 24. When the blade mounting plate 24 is driven downwardly, the four triangular blades 20 and 22 penetrate and progressively shear the square top from the welding rod can. This shearing action provides a clean cut and does not create any metal debris or leave any jagged edges. Different lengths of blades may be utilized to adapt the opener for use with rectangular welding electrode cans, without departing from the scope of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved welding electrode can opener, comprising:

an elongated rectangular base plate;

four upstanding walls forming a can receiving box on a central to portion of said base plate;

four upstanding elongated right angle corner rails mounted at corner portions of said can receiving box;

four side support braces connecting said corner rails, said support braces forming a square and secured at a midpoint of said corner rails;

a pair of "L"-shaped side support rails on opposite ends of said elongated base plate, each of said side support rods having a first end secured to one of said side support braces and an opposite end secured to said base plate;

a square top guide plate mounted on upper ends of said four corner rails;

a pair of circular guide apertures formed through said top guide plate;

a pair of slide bearings mounted on an underside of said guide plate in registry with said guide apertures;

a pair of elongated circular slide rods extending through said guide apertures and slidably mounted in said slide bearings;

a transversely extending cross bar secured to upper ends of each of said slide rods;

a pair of handle grips disposed on opposite ends of said cross bar;

a resilient shock absorbing block secured to an upper service of said top guide plate between said guide apertures;

an elongated ejector pin extending downwardly from a bottom surface of said top guide plate;

a square blade mounting plate connected to bottom ends of said slide rods;

a central circular ejection apertured formed through said blade mounting plate;

four triangular shaped cutting blades formed form tempered steel and having a thickness of about one sixteenth of an inch secured along side edges of said blade mounting plate, each of said blades extending perpendicularly downwardly from said blade mounting plate; and a pair of coil springs connected between said side support rods and said cross bar.

* * * * *